US006689261B1

(12) United States Patent
Iacopetti et al.

(10) Patent No.: US 6,689,261 B1
(45) Date of Patent: Feb. 10, 2004

(54) DIAPHRAGM ELECTROLYZER

(75) Inventors: Luciano Iacopetti, I-Pieve Emanuele (IT); Giuseppe Faita, Novara (IT)

(73) Assignee: De Nora Elettrodi S.p.A. (IT)

( * ) Notice: Subject to any disclaimer, the term of this patent is extended or adjusted under 35 U.S.C. 154(b) by 0 days.

(21) Appl. No.: 10/129,068

(22) PCT Filed: Nov. 7, 2000

(86) PCT No.: PCT/EP00/10989

§ 371 (c)(1),
(2), (4) Date: Apr. 26, 2002

(87) PCT Pub. No.: WO01/34878

PCT Pub. Date: May 17, 2001

(30) Foreign Application Priority Data

Nov. 8, 1999 (IT) ..... MI99A2329

(51) Int. Cl.[7] ..... C25B 9/00; C25B 9/04
(52) U.S. Cl. ..... 204/252; 204/279
(58) Field of Search ..... 204/252–258, 204/279

(56) References Cited

U.S. PATENT DOCUMENTS

| | | | |
|---|---|---|---|
| 3,836,438 A | 9/1974 | Sartre et al. | 204/279 |
| 3,928,167 A | 12/1975 | Bouy et al. | 204/286 |
| 4,045,323 A | 8/1977 | Boggs | 204/266 |

*Primary Examiner*—Donald R. Valentine
(74) *Attorney, Agent, or Firm*—Muserlian, Lucas and Mercanti

(57) ABSTRACT

The invention relates to an improved design of electrolyzer, in particular to the design of a diaphragm electrolyzer for the production of chlorine and alkali from aqueous solutions of alkali chlorides, comprising at least one anode fixed to an anodic base and in electrical contact therewith by means of a current collecting stem separated from the electrolyte circulating in the anodic compartment by means of a hydraulic seal system, wherein a conductive and deformable contact element is interposed between said current collecting stem and said anodic base, and wherein the hydraulic seal system comprises at least one O-ring.

11 Claims, 9 Drawing Sheets

DIAPHRAGM ELECTROLYZER

This application is a 371 of PCT/EP00/10989 filed Nov. 7, 2000.

BACKGROUND OF THE INVENTION

The production of chlorine is among the most widespread process in the world-wide scenery of industrial chemistry. The current annual production, which can be esteemed as about 50 million tons, comes almost entirely from the electrolysis of alkali chlorides in aqueous solutions; in these processes, chlorine is evolved through the anodic discharge of chloride ions, typically with the concurrent production of alkali at the cathodic compartment; in the most typical case at the cathode also the reaction of hydrogen evolution takes place. Of the three types of electrolytic cells most commonly employed for this purpose—the mercury cathode, membrane and diaphragm ones—the latter still accounts for the highest global amount of chlorine produced in the world-wide market. FIG. 1 shows a modem diaphragm cell, comprising an anodic base (1), made of a copper body lined with a thin sheet of titanium, whereupon anodes: (2) are fixed by means of current collecting copper stems (4), also protected with a titanium coating. The reason for these bimetallic constructions arises from the fact that copper, employed for its excellent electric properties, would be easily corroded by the anolyte (chlorinated brine), toward which, on the contrary, titanium shows good resistance characteristics. The cathode (3), on one side of which, and precisely on the side facing the anode, a diaphragm is deposited, is made of foraminous iron sheets or meshes. The cover (5), made of a chlorine-resistant plastic material, is provided with an outlet duct for the gaseous product chlorine (6) and of an inlet duct for brine feeding (not shown). The hydrogen and the alkaline solution (e.g. caustic soda solution) produced at the cathode exit respectively from the ducts (7) and (8). The diaphragm, having the purpose of separating the anodic and cathodic compartments, was traditionally made of asbestos fibres and a plastic binder; the need of abandoning the use of asbestos, noxious for the health, together with the quest for higher yields and longer duration of the elements, led to a radical re-thinking of the traditional diaphragms in terms of materials. Present day diaphragms are typically constituted of zirconium oxide fibres, or of plastic materials. Whereas asbestos based diaphragm were the component which determined the lifetime of the whole cell (an average of 10–14 month), the availability of the diaphragms of the new generation, known as "NAD" (non-asbestos diaphragm), would allow extending the operative time of a diaphragm cell from a minimum of 36 to a maximum of 60 months, before their degradation. The current experience, however, indicates that another factor limits the total lifetime of diaphragm electrolytic cells for the production of chlorine, and is substantially associated with corrosion phenomena in the anodic compartment. In particular, the seal between the bimetallic current collecting stem (4) whereupon the anodes (2) are secured, and the copper anodic base (1) is realised by means of a gasket (9), as shown in FIG. 2. The experience on the best currently available gaskets permits to forecast a lifetime of 12–24 months in the typical operating conditions. The multiplicity of seals in a cell, wherein several tens of anodes (typically 40 to 90) are present, further increases the probability for a gasket to undergo a rupture, or anyway that it give rise to a leakage, well before the lifetime of the NAD diaphragms is over. When a leakage occurs in correspondence of the anodic stems (4), it is necessary to shut-down the cell because the following phenomena, each one of which is critical, take place:

- impairment of the bimetal of the anodic stem (4), due to the corrosive action of the electrolyte.
- impairment of the copper base, due to the same phenomenon
- risk of electric grounding of the cell.

On the other hand, the shut-down of the cell and its opening for replacing the gaskets implies also the need of replacing the diaphragms, which during operation undergo a permanent deformation hampering their use in a subsequent assemblage. Assuring a leak-free sealing of the anolyte towards the anodic current collecting stems for the maximum lifetime of the NAD diaphragm (60 month), is an issue of fundamental importance in the economics of the diaphragm chlor-alkali electrolysers, as it would not be acceptable to nullify even partially the improvements that NAD technology has introduced on the duration of the diaphragms. FIG. 2 represents the state of the art in the field of sealing of the anodic current collecting stem. In particular, the embodiment shown in FIG. 2 comprises a current collecting stem (4), for instance a 1¼" (31.75 mm) stem with ¾" UNC female thread, fit for hosting a dowel screw (10) with the corresponding male thread. The electric contact between the anodic base (1) and the current collecting stem (4) is mostly assured by the tightening of the exposed copper part of such stem (4) to the copper current collecting bottom (11) of the anodic base (1). The simultaneous current flow from the copper bottom (11) to the dowel screw (10) through the thread of the tightening nut (12) is considered as negligible, both for the number of conduction interfaces and for the smaller section involved. The separation between the copper bottom (11) of the anodic base (1) and the anolyte is achieved, as above described, by means of an anodic liner (13) made of a titanium sheet, for instance a 1 mm thick sheet, perforated and activated in correspondence of the stems (4) which is also a fundamental integrating part of the anodic seal. The gasket (9) is typically a torus made of a hydrocarbon-based elastomer (for instance EPM or EPDM), pressed to the anodic liner (13) by means of a collar (14). The collar (14) is preferably made of a titanium-palladium alloy, to have a suitable resistance to crevice corrosion, and may have for instance a diameter of 50.0–50.8 mm and be welded at a distance of 4.7 mm from the bottom of the stem (4). The gasket (9) works therefore under predetermined deformation, which in the case of the aforementioned exemplary dimensions would be 3.7 mm in the lined zone. The typical starting thickness may be, for instance, of 6 mm, so as to achieve the typical compression ratio of 40%; even considering the whole contact region between toroidal rubber gasket (9) and anodic liner (13) as the effective seal bearing, it is evident how restricted is its width; for instance, for a collar (14) with a diameter of 50 mm in correspondence of a hole in the liner (13) with a diameter of 35 mm, the resulting width of the seal bearing zone is just 7.5 mm. The clamping load delivered by the dowel screw (10), which is normally made of brass or copper-nickel alloy, is limited by the mechanical resilience of the threaded portion of the current collecting stem (4); an indicative value, typical for ¾" UNC threaded pieces, is about 8 kg.m. The above described prior art suffers the following limitations:

- the gasketing material (EPM, EPDM) has inadequate resistance to chlorine, in conjunction with a high surface exposed to the aggressive environment.
- The use of composite gaskets with a PTFE protective coating is made impossible by the high ratio of seat to compressed thickness (about 2:1) and by the high compression ratio (40%).

On the other hand, the use of PTFE derived material, such as Gylon® (commercialised by Garlock, USA) or Permanite™ Sigma (commercialised by TBA, United Kingdom), is impeded by the scarce compressibility and consequently by the need of using very high mechanic loads to assure the sealing.

The compression load is not well defined, since the gasket works at predetermined deformation, as above described.

The combination of these factors strongly limits the lifetime of the anodic sealing gaskets (9), hampering, as above disclosed, the whole economics of the operation of diaphragm cells. An attempt of solving the aforementioned problems is described in the Swedish Patent Application 97 020 79, and in the corresponding technology commercialised by Akzo Nobel under the trademark Tibac™. Such finding consists in the direct welding of the collar (14) to the anodic liner (13), carried out by means of a laser. In this way, no polymeric material is used for sealing, with evident advantages in terms of reliability, as every polymeric gasketing material is to some extent subject to corrosion. By means of this technique, however, some undeniable drawbacks are introduced: as apparent, the anodes (2) aren't anymore detachable from the anodic liner (13) and consequently from the base (1), with negative consequences both in terms of handling during assemblage and maintaining procedures, and of possibility of conveniently reactivating the anodes (2) once their catalytic coating becomes exhausted. Furthermore, the weld bead has a remarkable extent, and the risks of leakage due to local defects are therefore high. A second partial solution to the problem consists in the use of a gasket (9), provided with a lip (15) and shaped as shown in FIG. 3. The constructional principle contemplates the exposition to chlorine of a reduced elastomer surface. In this manner, the possibility of detaching the anodes (2) from the anodic base (1) is retained, guaranteeing at the same time an extended lifetime of the gasket (9) in view of its decreased exposition to corrosive agents. This finding has proved however to be not yet sufficient to assure an adequate reliability, being the gaskets (9) still subject to corrosion-induced leaks in an average longer, but still unpredictable time. Moreover, the construction tolerances, from which the state of compression of the lip (15), which is very thin, depends, become more critical; from the state of compression of the lip (15) depends, on its turn, the chemical resistance of the same. Finally, in this type of gasket the seal is entrusted to the inner shaped ring which, in case an infiltration occurs, is destined to a quick collapse as it is thinner than a traditional gasket.

OBJECT OF THE INVENTION

Under a first aspect, it is an object of the present invention to provide a design of diaphragm electrolytic cell for the production of chlorine and alkali with improved reliability with respect to the state of the art, assuring a time of operation without maintenance or replacement of components being only limited by the lifetime of the NAD diaphragms.

Under another aspect, it is an object of the present invention to provide a seal system for anodes of diaphragm electrolytic cells for the production of chlorine and alkali preventing gasket corrosion phenomena for a minimum time of five years, at the same time retaining the possibility of detaching every single anode from the anodic liner.

Under another aspect, it is an object of the present invention to provide a seal system for anodes of diaphragm electrolytic cells applicable not only to cells of new construction, but also to cells designed and manufactured according to the prior art, eventually already in operation, allowing to prevent or overcome the occurrence of corrosion problems due to the fault of their seal system.

Under another aspect, it is a further object of this invention to provide a seal system for anodes of diaphragm electrolytic cells for the production of chlorine and alkali applicable to cells designed and manufactured according to the prior art which have already undergone pronounced corrosion phenomena, included the degradation of the anodic current collecting bottom (11).

SUMMARY OF THE INVENTION

A new configuration of hydraulic seal and electric contact between the anodic base (1) and the anodes (2) of a diaphragm electrolytic cell for the production of chlorine and alkali, allowing to entirely overcome the limitations of the prior art, is described herebelow. The constructional principle of the invention comprises a seal system based on an O-ring and a fixed mechanic spacer, and an electrical contact system based on the interposition of a conductive dimensionally adaptable intermediate layer between the anodic base (1) and the bottom of the current collecting stem (4). According to this new cell design, contrarily to what happens in the prior art, the component deformable upon cell clamping is an integral part of the electric contact, and not of the hydraulic seal. The innovative characteristics of the cell design of the invention are summarised in FIG. 4, and herebelow described. The hydraulic seal is based on an O-ring (16), instead than on the planar gasket (9), optionally provided with a lip (15), of the prior art. The O-ring (16) must have the following characteristics:

- be manufactured starting from a chemically inert, and possibly elastic, construction material
- have dimensions sufficient to compensate for the local irregularities
- seat exclusively on the anodic liner (13)
- have a low deformation load (for instance, substantially lower than a spirometallic seal).

Figure 5:
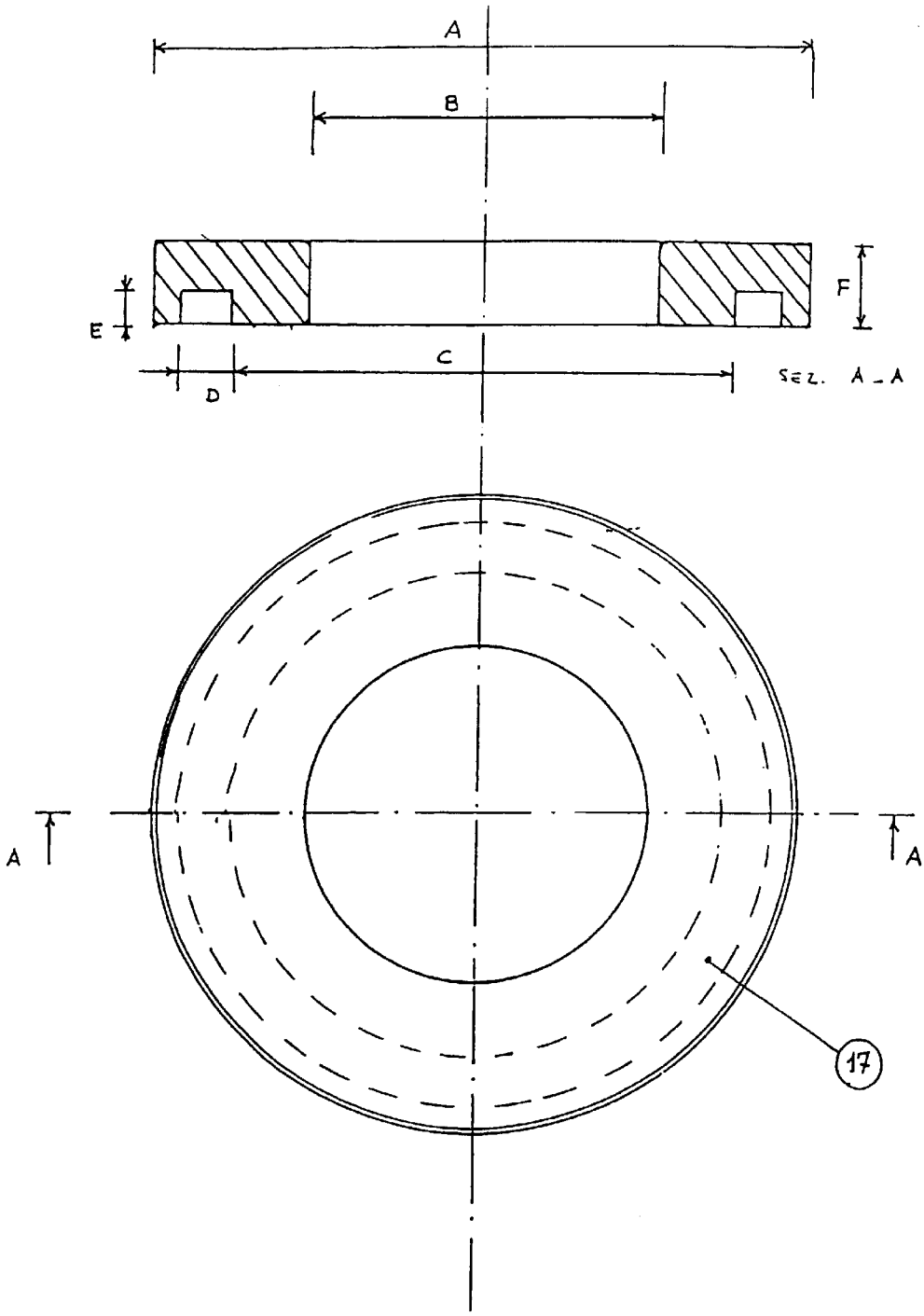
FIG. 5 is a topical view of the ferrule.

The anodic current collecting stem (4) is also provided with an additional ferrule (17) or equivalent element to delimit a slot for housing the O-ring (16); in a preferred embodiment of the invention, the ferrule (17) is obtained by lathe turning a titanium-palladium ring, as shown in FIG. 5, seating it to the collar (14) and optionally welding it thereto;

in the latter case, this embodiment is particularly adapted to be applied to cells manufactured according to the prior art, wherein the collar (14) is already present, and the ferrule (17) is welded later on, preferably according to the geometry shown in FIG. 4, wherein it is apparent how the outer position of the weld with respect to the bimetal of the stem (4) avoids hampering the structural integrity of the latter upon subjecting it to high temperature. In the case of new constructions, the collar (14) and the ferrule (17) can be manufactured as a single piece, provided with an adequate slot to house the O-ring. In the selection of the construction material for the O-ring, the chemical inertia of the latter is particularly important; in particular, purely elastomeric O-rings are not an acceptable solution. Suitable for this purpose are instead the O-ring made of an elastomeric core coated with an inert film, for instance a fluorinated film. Composite O-rings of this kind may be selected, for instance, among the following categories:

O-rings coated with FEP, a polymer characterised by a very reduced chlorine diffusion. An example of FEP-coated commonly available O-ring is FEP-O-SEAL™, commercialised by the Swiss company Angst-Pfister, having a thickness of fluorinated film of 0.25 mm. A material preferably used for the elastomeric core is Viton®, well resistant to dry chlorine attack, i.e. to the conditions that may arise upon diffusion of chlorine through the O-ring's fluorinated film.

PTFE-coated O-rings; in this case, the thickness of the protective film must be higher (preferably 0.75–0.8 mm), and the core must preferably have emphasised elastic characteristics. Preferably, a silicon rubber material, on which the protective film is applied by welding, is selected as the elastomeric core.

Figure 6:
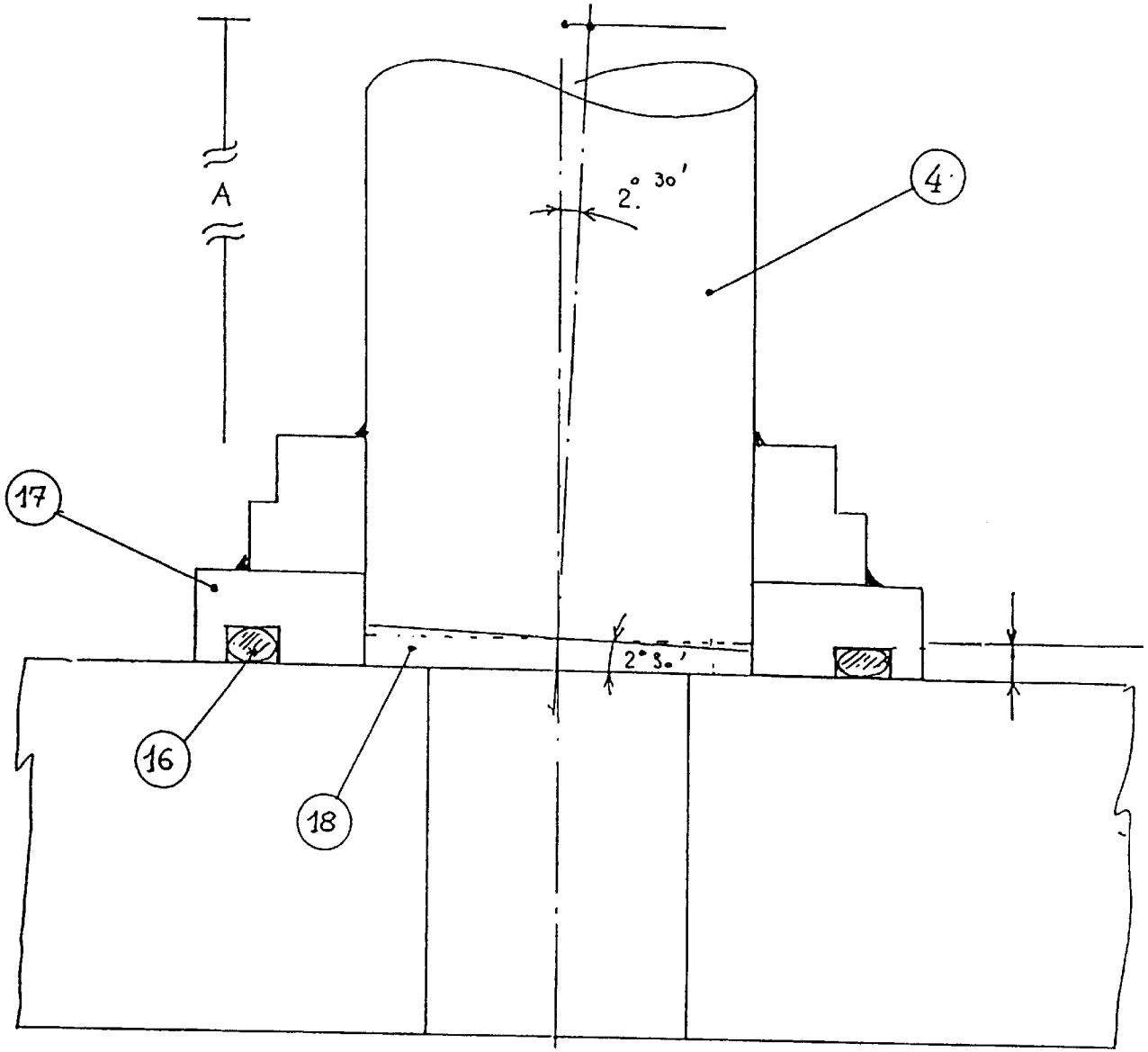
FIG. 6 illustrates the orthogonality between the ferrule and the bimetallic stem.

The O-rings selected in accordance with the previously disclosed criteria, due to the thickness related protection and the reduced exposition to the liquid, can remain in operation for many years; the above described elastomeric cores are suited for continuous operation up to temperatures comprised between 150 and 180° C., versus 90–95° C. typical of the diaphragm process; moreover, the eventual irregularities or impairments of the anodic liner are compensated by the pressure exerted by the collar. The electric contact must be realised by means of a deformable element (18), and at the same time it must be efficient so as to sustain a high current intensity; the latter in fact may reach 2000 A. As shown in FIG. 4, the height of the gap between the copper current collecting bottom (11) and the bottom of the anodic stem (4) is determined by the thickness of the added titanium-palladium ferrule (17), in case a pre-existing cell is modified. As previously specified, in case a new cell is manufactured, the ferrule (17) or equivalent element is integral to the collar (14), and the position of this integrated piece will determine the height of the gap between current collecting bottom (11) and anodic stem (4). The tolerance of such height depends however from constructional factors, among which the most decisive is the orthogonality between the ferrule (17) and the bimetallic stem (4), as shown in FIG. 6. The deformability of the electric contact element (18) serves precisely to compensate similar deviations, and the optimal choice of such component proves to be decisive for the electric efficiency of the whole process. A suitable solution to produce the deformable contact element (18) is given by the use of massive silver, a metal having the following characteristics:

low contact potential drop also at very low clamping loads high deformability, making it adaptable to eventual thickness irregularities with limited loads, moreover with a tendency to seal the two copper surfaces to be coupled as if it were a veritable metallic gasket.

Although in the following description reference to pure silver contact elements, e.g. 99.9% pure "Fine Silver", will be made, it will be understood that other silver materials having equivalent characteristics in terms of electric conductivity and mechanical deformability may advantageously be used. For instance, the silver alloy known as "Sterling Silver" or "Silver-Copper Alloy", containing about 7.5% copper, is widely employed for all kinds of electric contacts, and may be suited for this purpose. Other silver alloys that may be employed are the silver-zinc-antimony alloy known as "Silanca", as well as the so called "Coin Silver" alloys, containing 2.5% of either aluminum or copper.

Figure 1:
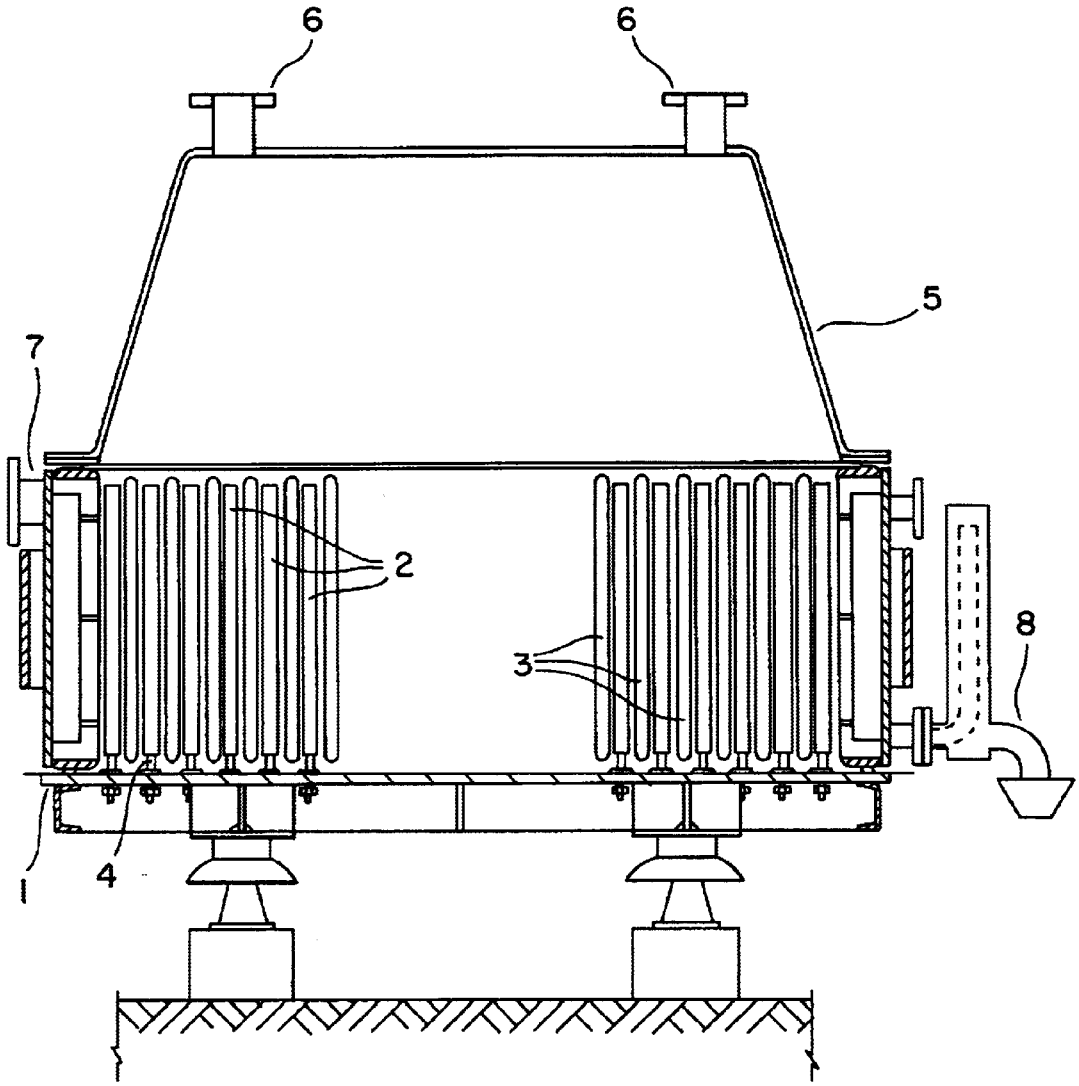
Fig. 1 PRIOR ART
FIG. 1 is a cross-section of a known diaphragm cell.
Figure 2:
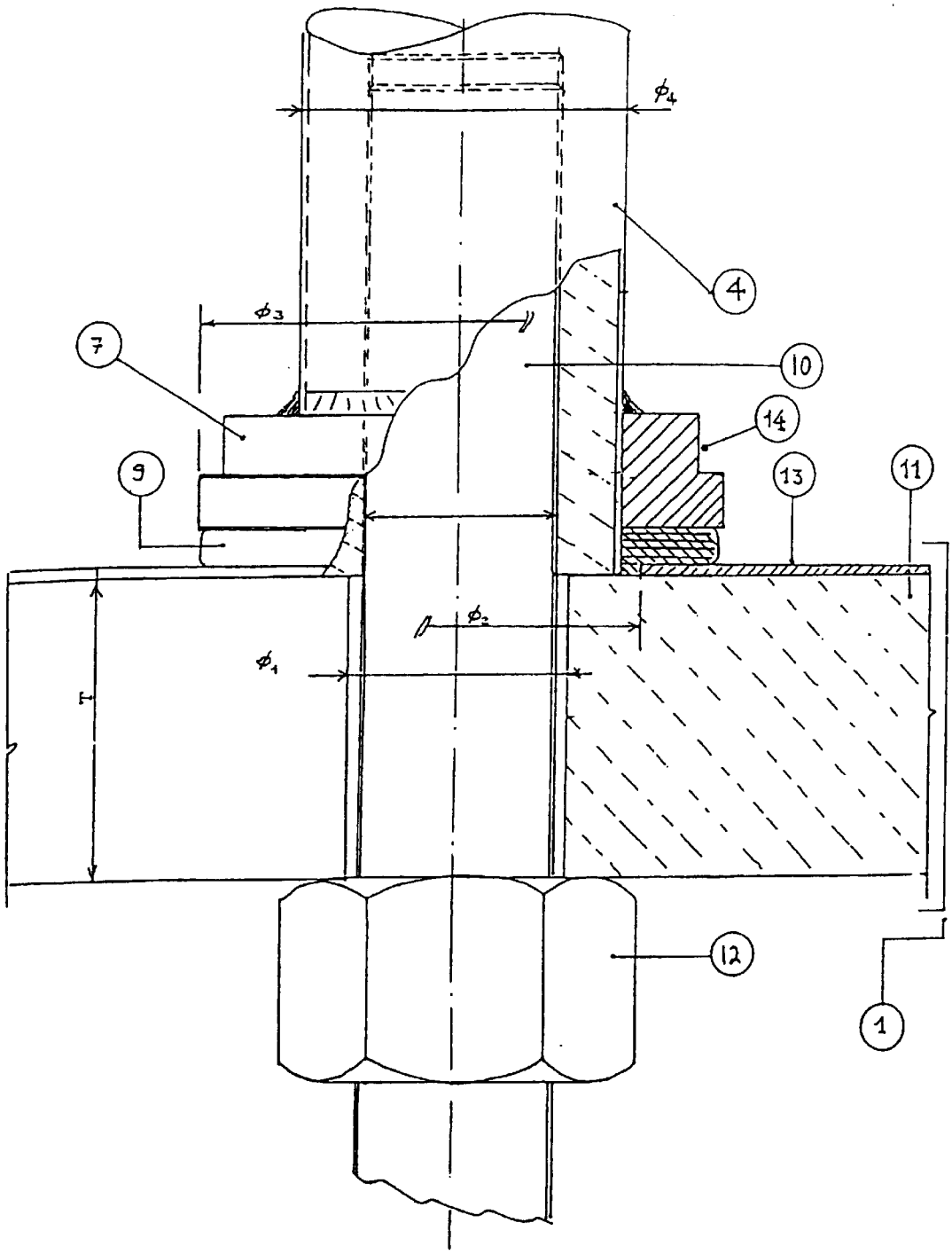
FIG. 2 is a cross-section of the current collecting stem and the anodic base.
Figure 3:
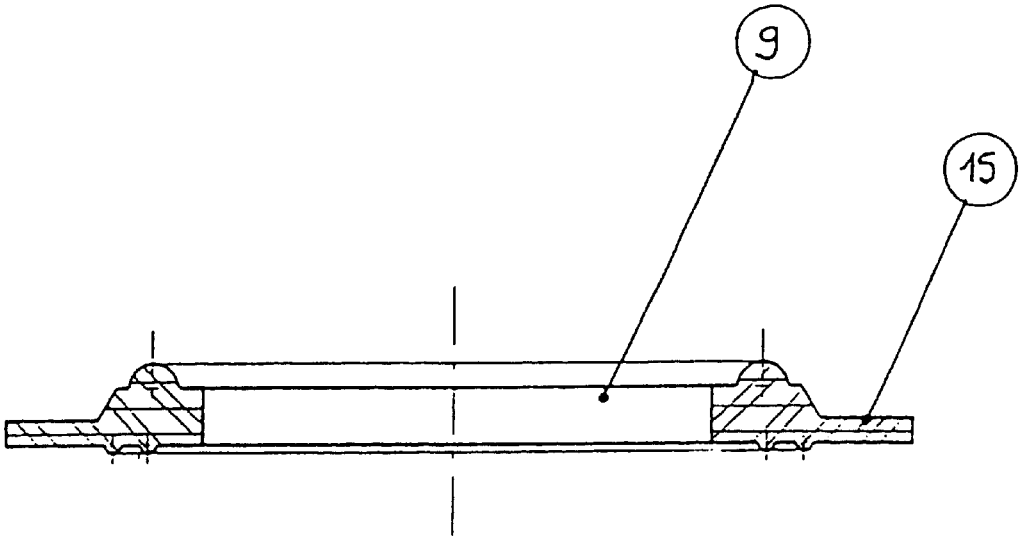
FIG. 3 is a cross-section of the sealing gasket of FIG. 2.
Figure 4:
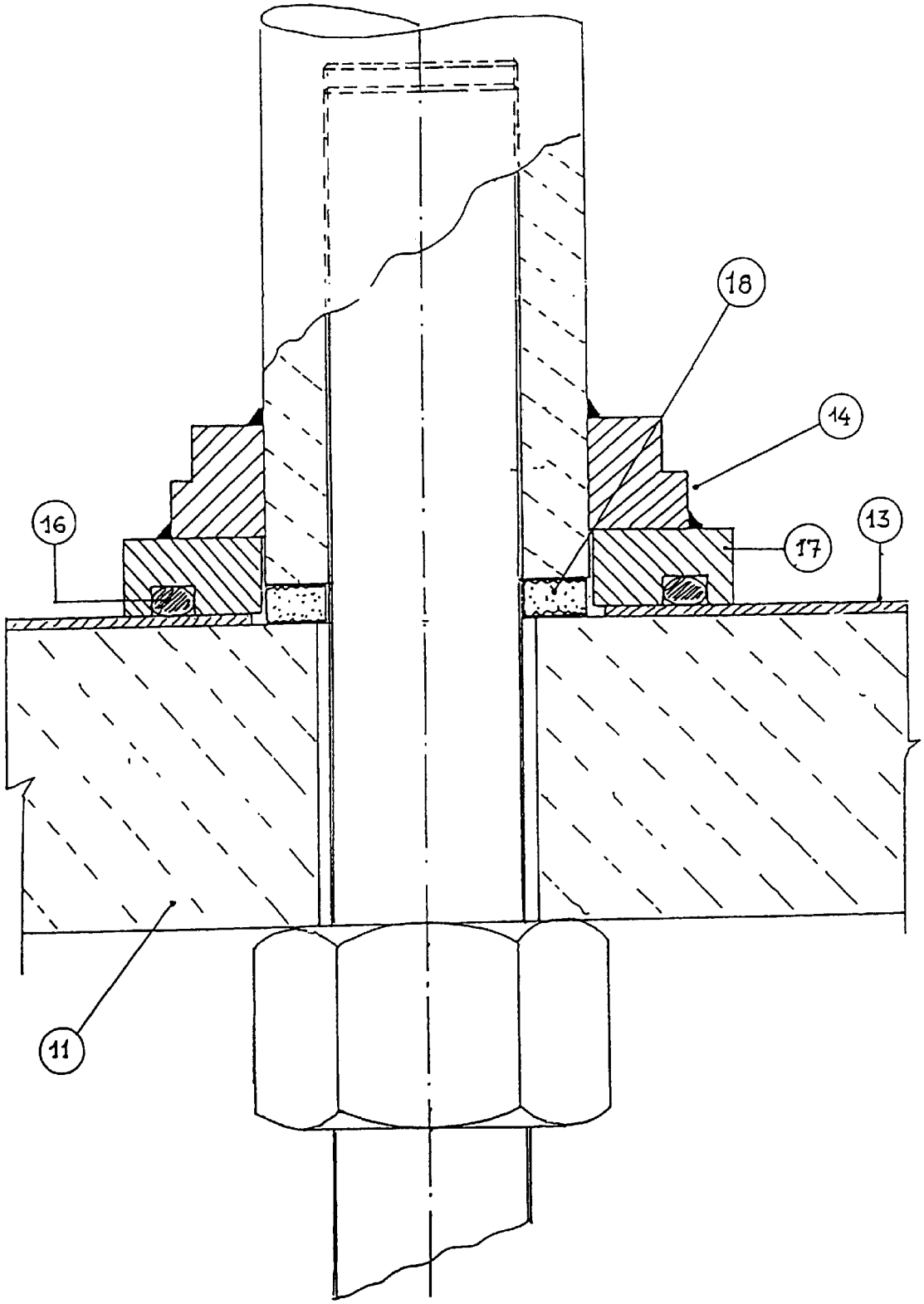
FIG. 4 is a cross-section of the sealing means of the invention between the current collecting stem and the anodic base.
Figure 7:
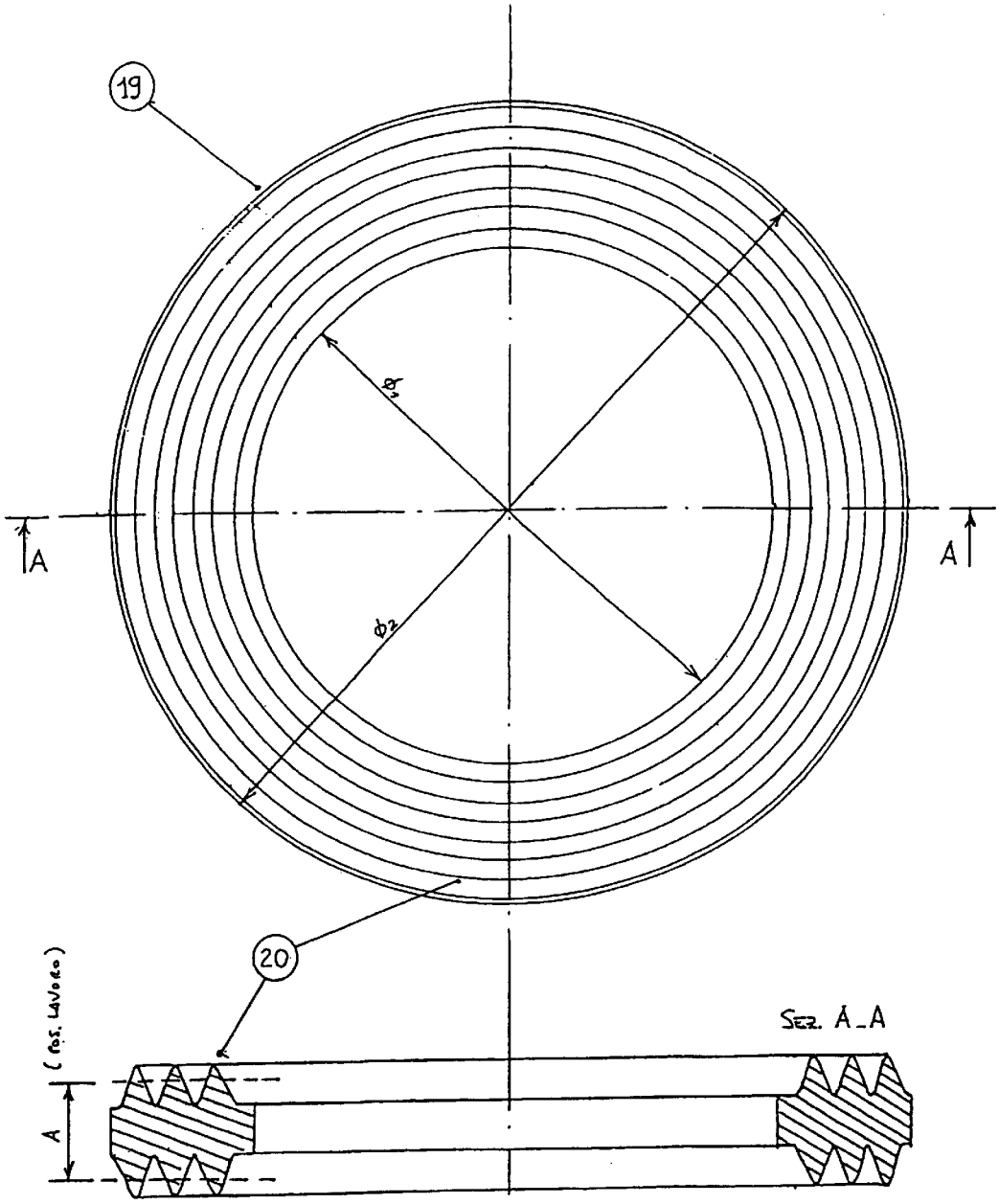
FIG. 7 illustrates the intermetallic contact element with a "washer type".
Figure 8:
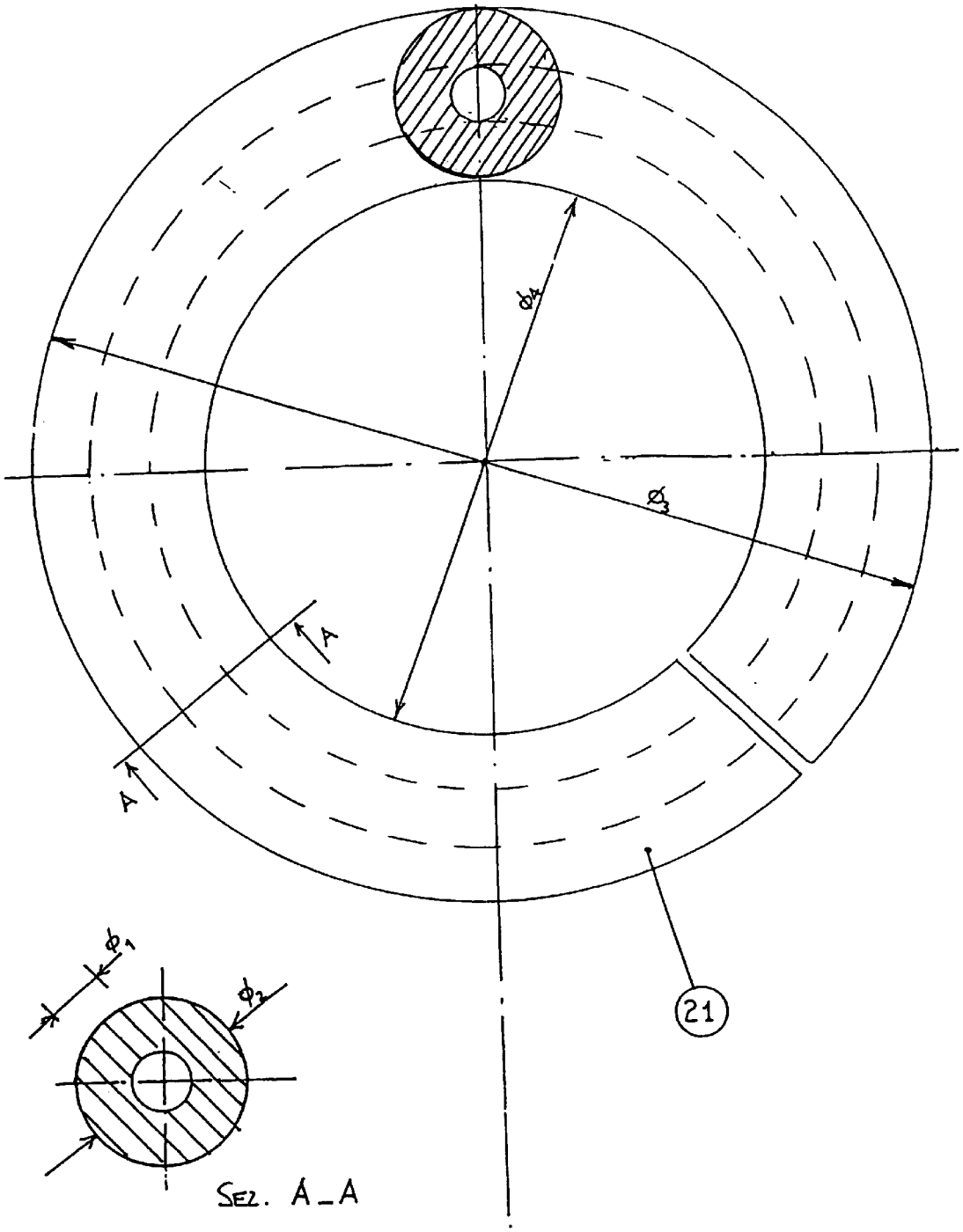
FIG. 8 illustrates the "ring type" contact element.
Figure 9:
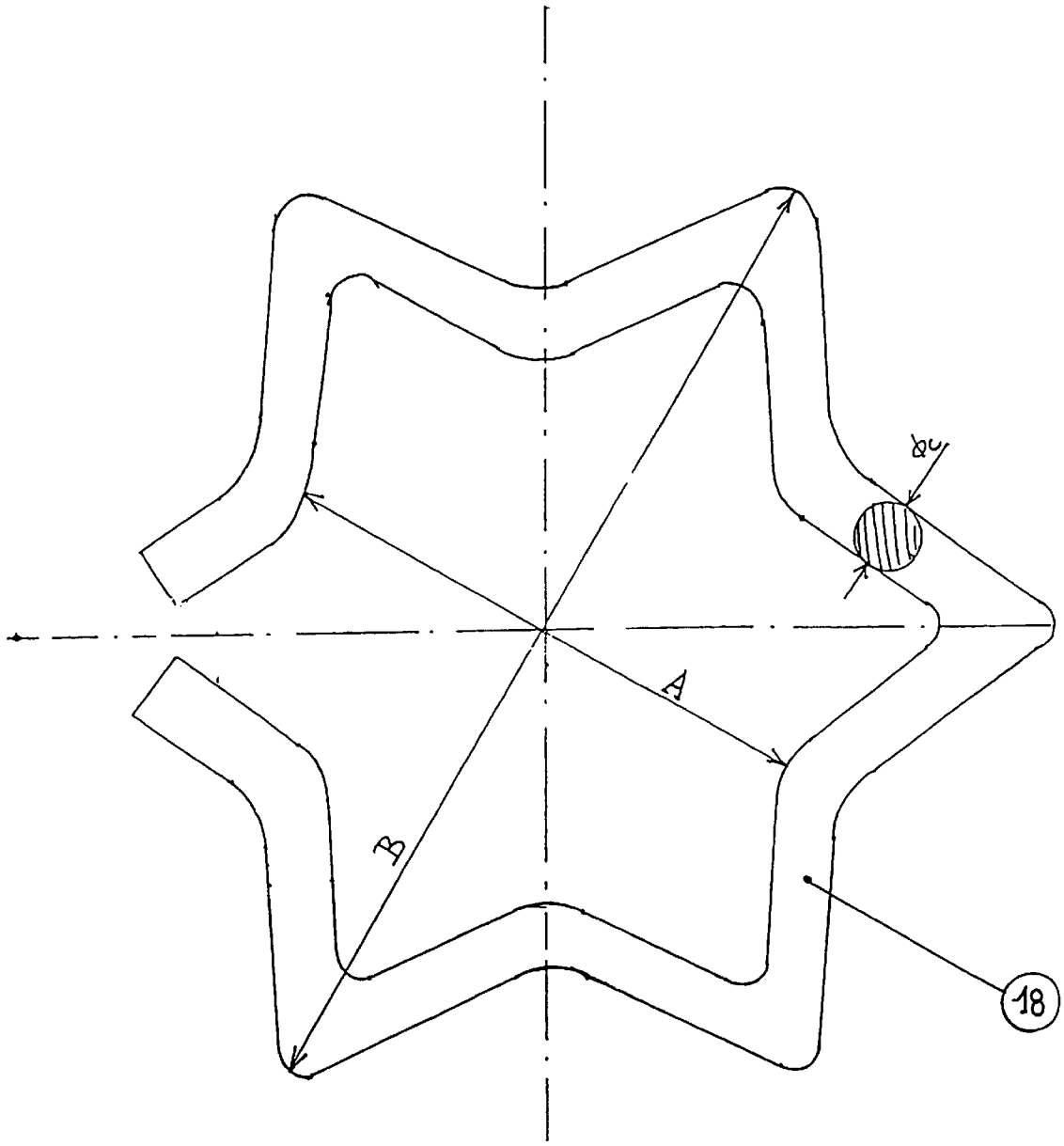
FIG. 9 illustrates a close-shaped contact element.

In a diaphragm cell of the invention, corresponding to what shown in FIG. 4, it is possible, by means of a silver deformable contact element (18), to make a direct current flow up to 3500 A retaining a contact potential drop lower than 1 mV, with the usual clamping loads required for sealing. A particularly preferred geometry to decrease the use of silver in the intermetallic contact element is the "washer type" one, shown in FIG. 7. In this case, it is apparent the importance of guaranteeing the compression of the whole washer in working conditions. For this reason, the washer (19), made of a central continuous base typically a few millimetres thick is provided on its two faces of regular asperities, for instance of concentric reedings (20), acting as preferential points or regions of contact seat. In a typical embodiment, the total height of the piece is 3.7 mm, and the reedings, initially of 1.5 mm, undergo a 0.85 mm compression on each side, corresponding to the absorption of 1700–2000 kg of contact. With these parameters, for reedings (20) having superficial crests equivalent to 40% of the projected area of the washer, potential drops comprised between 2 and 3 mV were measured at 2000 A direct current flow, which is still a fully acceptable value. Another preferred embodiment, offering a simpler construction with respect to the washer type contact, is given by the "ring type" contact element, as shown in FIG. 8. The ring (21) is obtained through the simple cutting of a silver pipe; this type of contact has the advantage of a quick initial deformability, and therefore of a quick adaptation, nevertheless it is not suitable for too high clamping loads. Another preferred embodiment of the invention contemplates the use of a close-shaped contact element, for instance according to what shown in FIG. 9. The peculiar characteristic of this embodiment is the localisation of the contact on small surfaces subject to a high load. The petal shape shown in FIG. 9 is helpful to the assemblage, as it imparts self-centring characteristics to the piece; as apparent, many different close-shaped contact elements may achieve the same function, resulting technically equivalent. Even though all of these types of contact elements require the replacement when the anodes are removed (e.g. for mechanical repairing, or for electrocatalytic recoating), as they are subject to plastic mechanical deformation, the pure silver employed for their construction can be easily and entirely recovered at the end of the life cycle of the piece. The fastening of the anodic structures on the cell bottom is carried out by acting on the tightening nut (12); the typical torque is about 8 kg.m. The seal system of the invention, based on the use of O-rings, does not require any elastic device, such as Belleville-washers inserted between copper bottom (11) and nut (12), as the general trim is defined by the rigid contact of the ferrule (16) surface with the liner (13); the same applies to the silver contact element, confined in the slot delimited by the collar-ferrule system. The above disclosed cell design thereby completely overcomes the problems deriving from the use of exposed corrodible gaskets, is suitable for operation also at high current density, and presents a remarkable flexibility in terms of possible ways of implementation. The herein disclosed constructional solutions have the sole purpose of exemplifying some possible ways of implementing the invention without limiting its extent, which is only defined by the following claims.

What is claimed is:

1. A diaphragm cell for the electrolysis of alkali chlorides, comprising at least one anode fastened to an anodic base and in electrical contact therewith by means of a current collecting stem separated from the circulating electrolyte in the anodic compartment through a hydraulic seal system, characterised in that a conductive and deformable contact element is interposed between said current collecting stem and said anodic base, and the hydraulic seal system comprises at least one O-ring, positioned in correspondence of said current collecting stem and housed in a slot delimited by said anodic base and by one containing element fastened on said current collecting stem.

2. The cell of claim 1, characterised in that said O-ring is made of an elastomeric core, coated with a layer of a material with low chlorine diffusivity and chemically inert.

3. The cell of claim 1, characterized in that said contact element is made of silver.

4. The cell of claim 3, characterised in that said contact element is a massive silver contact element.

5. The cell of claim 3, characterised in that said silver contact element has the shape of a washer provided with reedings.

6. The cell of claim 3, characterised in that said contact element is ring-shaped.

7. The cell of claim 3, characterised in that said contact element has a closed shape.

8. The cell of claim 7, characterised in that said closed shape imparts a self-centring feature to said contact element.

9. The cell of claim 1 characterised in that said containing element is a ferrule welded on a collar.

10. The cell of claim 1 characterised in that it is obtained by modifying a pre-existing cell, in which said containing is a collar and an additional containing element is welded thereto, and in which said hydraulic seal system comprising at least one O-ring is provided as a replacement of a pre-existing hydraulic seal system comprising at least one planar gasket, optionally provided with at least one lip and interposed between said collar and said anodic base, wherein said pre-existing seal system is removed before the assemblage of said hydraulic seal system comprising at least one O-ring.

11. The cell of claim 10 characterised in that said additional containing element is a ferrule.

* * * * *